US012789070B2

(12) United States Patent
Perez Quinonero

(10) Patent No.: US 12,789,070 B2
(45) Date of Patent: Nov. 10, 2026

(54) SUPPORT AND FASTENING SYSTEM FOR A PORTABLE DEVICE FOR PLAYING GOLF

(71) Applicant: GRAVIT PRACTICE GOLF, S.L., Valencia (ES)

(72) Inventor: Jose Luis Perez Quinonero, Valencia (ES)

( * ) Notice: Subject to any disclaimer, the term of this patent is extended or adjusted under 35 U.S.C. 154(b) by 364 days.

(21) Appl. No.: 18/555,689

(22) PCT Filed: Apr. 15, 2021

(86) PCT No.: PCT/ES2021/070251
§ 371 (c)(1),
(2) Date: Oct. 16, 2023

(87) PCT Pub. No.: WO2022/219208
PCT Pub. Date: Oct. 20, 2022

(65) Prior Publication Data
US 2024/0198200 A1 Jun. 20, 2024

(51) Int. Cl.
*A63B 69/36* (2006.01)

(52) U.S. Cl.
CPC ..... *A63B 69/3676* (2013.01)

(58) Field of Classification Search
CPC ..... A63B 69/3676; A63B 57/40
See application file for complete search history.

(56) References Cited

U.S. PATENT DOCUMENTS 2,899,207 A * 8/1959 Billinghurst ..... A63B 57/357 273/127 B
5,924,938 A * 7/1999 Hines ..... A63B 53/02 473/307
2002/0193172 A1 12/2002 Fuller
2013/0221615 A1 8/2013 Stevens Kang

FOREIGN PATENT DOCUMENTS

ES 1220704 * 11/2018
ES 1220704 U 11/2018
GB 2438377 A 11/2007

* cited by examiner

*Primary Examiner* — Michael D Dennis
(74) *Attorney, Agent, or Firm* — Patenting Consulting Group; Roberto J Rios

(57) ABSTRACT

Internal thread and fastening washer for a transportable device for playing golf, comprising a cylindrical recess (1) in the lower base (2) of the counterweight (3), in which there is a lower threaded rod (4) that screws on a cylinder with a threaded interior (5) fastened in the center and protruding from the lower disc (6). Furthermore, it has a serrated washer (7) that surrounds the threaded cylinder (5) and is fixed on the lower disc (6).

11 Claims, 3 Drawing Sheets

SUPPORT AND FASTENING SYSTEM FOR A PORTABLE DEVICE FOR PLAYING GOLF

INDUSTRY SECTOR

The present invention concerns a series of innovative elements that are incorporated into the transportable device for playing golf of utility model ES1220704U, such as to facilitate its assembly and improve its robustness and stability. The industry sector that the present invention is located in therefore relates to the leisure industry, in particular for playing golf in areas chosen by the user.

BACKGROUND OF THE INVENTION

The invention is based on the transportable device for playing golf of utility model ES1220704U, comprising two discs designed with a central orifice that are mounted in parallel position on the upper and lower base of a vertical counterweight and fitted with means to anchor the discs to it, thereby creating a stable assembly in vertical position to hold the balls in the perimeter cavity formed between the discs while preventing, thanks to the counterweight and the immobility of the discs, the device assembly from tipping over due to blows from golf balls. This invention has some drawbacks. For example, there is no fastening element to secure the assembly when screwing the counterweight on the discs. Furthermore, the threaded rod of the counterweight protrudes from the lower side, which may pose a risk (due to the sharp elements of its thread) or be inconvenient when placing the assembly on a support base.

The present invention solves the aforementioned drawbacks by providing a serrated washer and a new configuration for the threaded cylinders and rods.

DESCRIPTION OF THE INVENTION

To achieve the aforementioned design goals, the invention comprises a cylindrical recess in the lower base of the counterweight, which has a threaded rod that screws on a cylinder with an interior thread that protrudes from the centre of the lower disc. Furthermore, it has a serrated washer that surrounds the threaded cylinder and is fixed on the lower disc.

This eliminates the protruding lower threaded rod, improving the design and reducing the risk inherent in the protrusion. Furthermore, the serrated washer fastens the counterweight to the lower disc.

The assembly has an upper disc to hold the ball and a mast to secure the upper disc by threading this mast with the upper rod of the counterweight. This achieves the perimeter cavity to house the golf ball. Signage can also be provided on the mast.

Fixed anti-slip silicone studs are provided on the lower disc of the device, acting as a support base to allow the device to adhere to any type of ground.

BRIEF DESCRIPTION OF THE DRAWINGS

In order to complement and help understanding of the characteristics of the invention, a sheet of drawings is attached in which, for illustrative and non-limiting purposes, the following have been represented.

Figure 1:
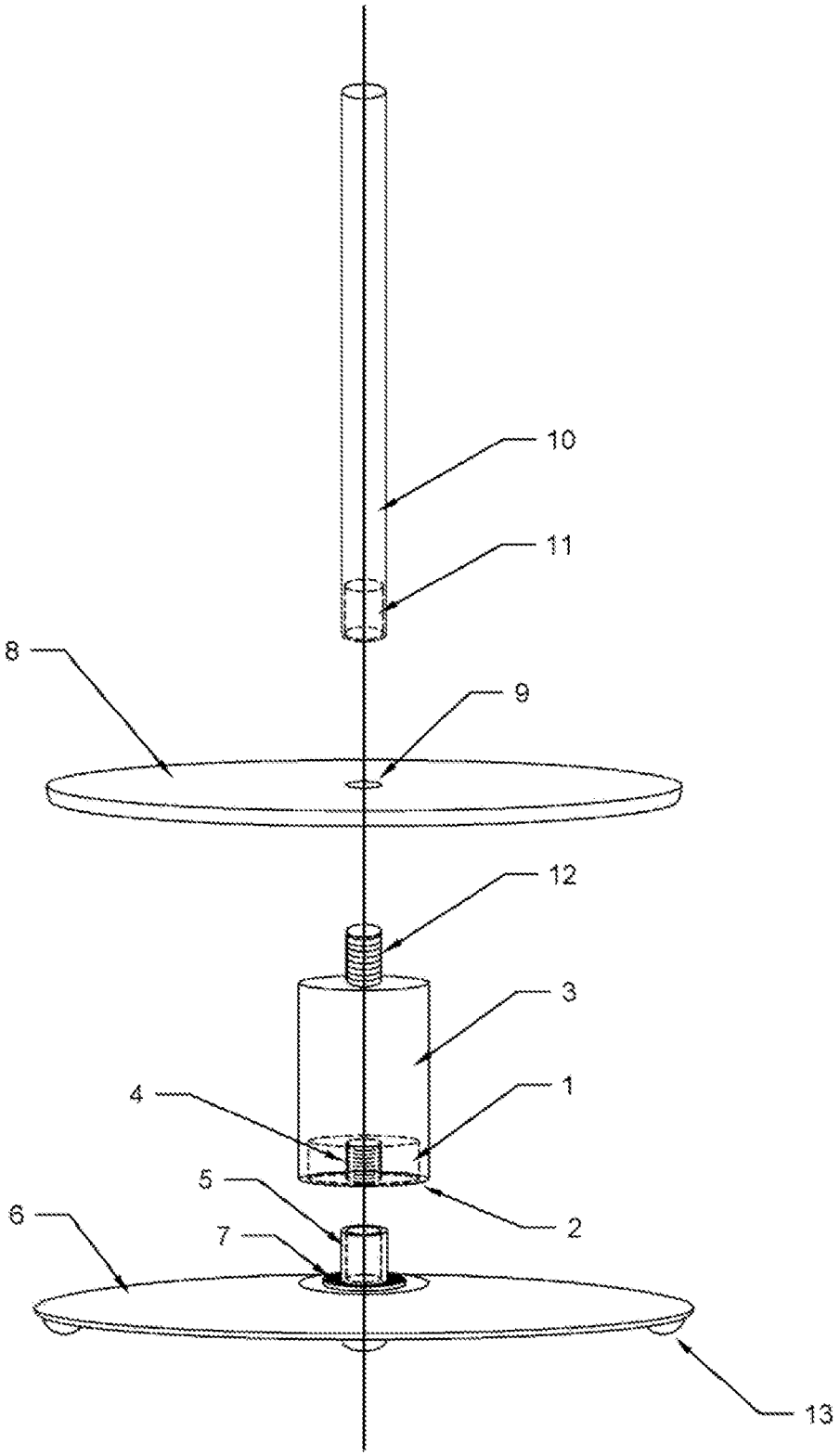
FIG. 1. —Shows an elevation view of the disassembled invention.
Figure 2:
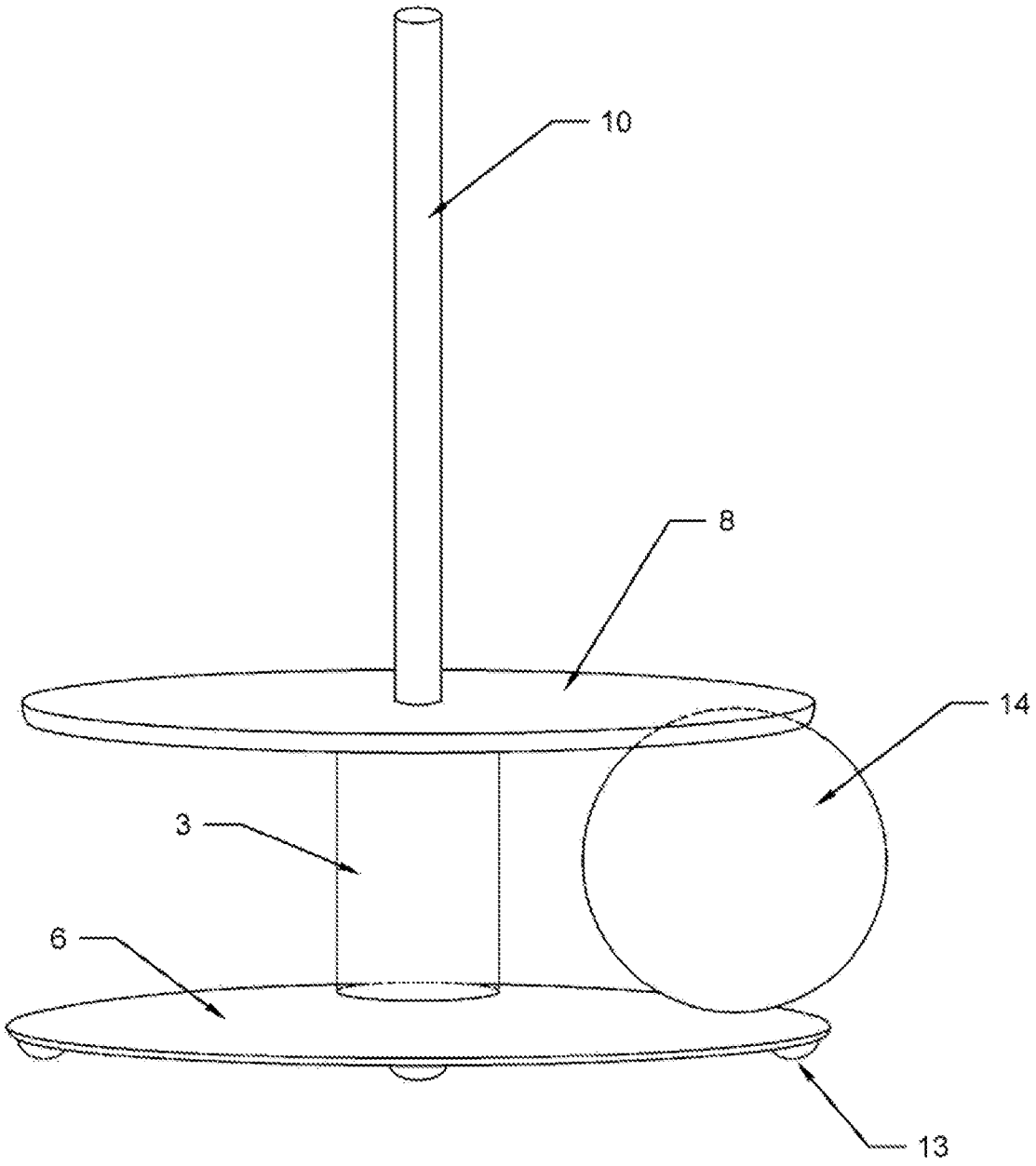
FIG. 2. —Shows an elevation view of the assembled invention.
Figure 3:
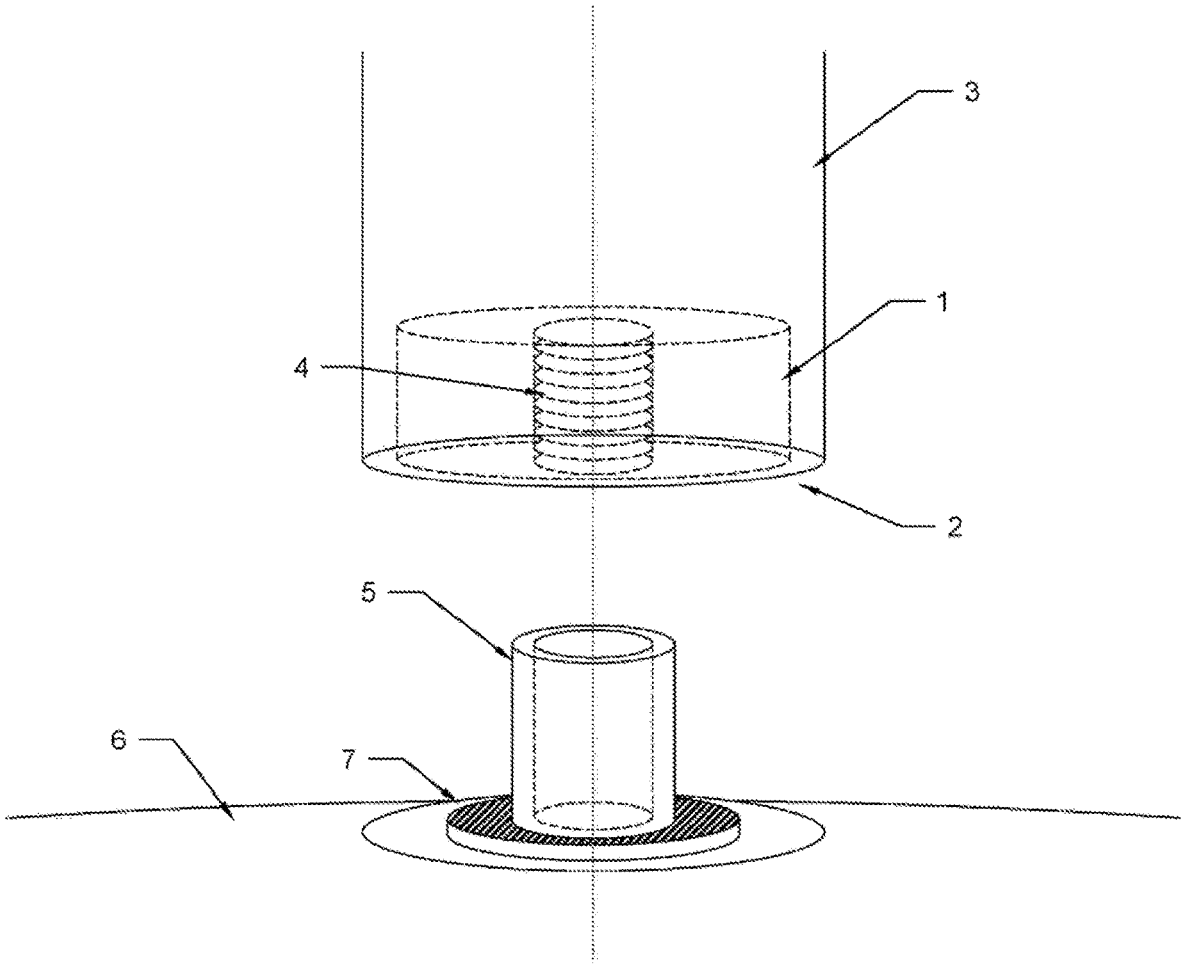
FIG. 3. —Detail of the lower base of the invention.

A list of the different elements shown in the figures that make up the invention is provided below.

1=Cylindrical recess in the lower base of the counterweight
2=Lower base of counterweight
3=Counterweight
4=Lower threaded rod
5=Lower disc cylinder with interior thread
6=Lower disc
7=Serrated washer
8=Upper disc
9=Upper disc orifice
10=Mast
11=Mast threading
12=Upper rod and counterweight threading
13=Non-slip silicone pads
14=Golf ball

PREFERRED EMBODIMENT OF THE INVENTION

The invention comprises a cylindrical recess (1) in the lower base (2) of the counterweight (3), in which there is a lower threaded rod (4) that screws on a cylinder with a threaded interior (5) fastened in the centre and protruding from the lower disc (6). Furthermore, it has a serrated washer (7) that surrounds the threaded cylinder (5) and is fixed on the lower disc (6).

The assembly has an upper disc (8) with a central orifice (9) to hold the ball (14) and a mast (10) to secure the upper disc (8) by threading the mast (11) with the upper threaded rod of the counterweight (12). This achieves the perimeter cavity to house the golf ball (14).

Fixed anti-slip silicone studs (13) are provided on the lower disc (6) of the device, acting as a support base to allow the device to adhere to any type of ground.

The invention claimed is:

1. A support and fastening system for a portable device for playing golf, said system comprising:

a counterweight having a lower threaded rod inside a cavity provided in a lower base of said counterweight, wherein the counterweight is positioned between a lower surface of an upper disc and an upper surface of a lower disc of the device, said lower threaded rod is adapted to screw on an internal threaded surface of a cylinder that protrudes from the upper surface of said lower disc; and a serrated washer that surrounds the cylinder, wherein the serrated washer is fastened to said upper surface of said lower disc.

2. The system according to claim 1, wherein said cylinder is provided on a center of the upper surface of said lower disc.

3. The system according to claim 1, further comprising anti-slip studs provided on a lower surface of said lower disc to secure the device on a surface.

4. The system according to claim 3, wherein said anti-slip studs are made of silicone.

5. The system according to claim 1, wherein said counterweight is cylindrical.

6. The system according to claim 1, wherein said cavity is cylindrical.

7. The system according to claim 1, wherein the cylinder is covered by said cavity when the lower threaded rod is screwed on the internal threaded surface of said cylinder.

8. The system according to claim 1, wherein said counterweight further comprises an upper threaded rod protruding from an upper surface of the counterweight.

9. The system according to claim 8, wherein said upper threaded rod is adapted to pass through an opening of said upper disc.

10. The system according to claim 9, wherein the opening of said upper disc is provided on a center of the upper disc.

11. The system according to claim 8, wherein said upper threaded rod is adapted to thread with an end of a mast.

* * * * *